US007096958B2

(12) United States Patent
Karayaka et al.

(10) Patent No.: US 7,096,958 B2
(45) Date of Patent: Aug. 29, 2006

(54) COMPLIANT BUOYANCY CAN GUIDE

(75) Inventors: Metin Karayaka, Houston, TX (US); John Montague, Houston, TX (US)

(73) Assignee: Technip France, Courbevoir (FR)

( * ) Notice: Subject to any disclaimer, the term of this patent is extended or adjusted under 35 U.S.C. 154(b) by 290 days.

(21) Appl. No.: 10/760,807

(22) Filed: Jan. 20, 2004

(65) Prior Publication Data

US 2005/0051338 A1 Mar. 10, 2005

Related U.S. Application Data

(63) Continuation-in-part of application No. 09/850,599, filed on May 7, 2001, now Pat. No. 6,679,331.

(60) Provisional application No. 60/283,240, filed on Apr. 11, 2001.

(51) Int. Cl.
*E21B 17/01* (2006.01)

(52) U.S. Cl. ..... 166/367; 166/350; 166/359; 114/264; 405/224.4

(58) Field of Classification Search ..... 166/350, 166/345, 359, 362; 114/266, 265, 267, 242, 114/264; 405/145.1, 215, 219, 224, 224.1, 405/224.4, 204, 205
See application file for complete search history.

(56) References Cited

U.S. PATENT DOCUMENTS

| | | | | |
|---|---|---|---|---|
| 2,669,960 | A | 2/1954 | Laycock | |
| 2,963,868 | A | 12/1960 | Armstrong | |
| 3,207,110 | A | 9/1965 | Laborde et al. | |
| 3,957,318 | A * | 5/1976 | Wiebe | 384/423 |
| 4,098,527 | A * | 7/1978 | Herbert et al. | 285/146.3 |
| 4,435,097 | A * | 3/1984 | Peterson | 384/221 |
| 4,448,266 | A | 5/1984 | Potts | |
| 4,740,109 | A | 4/1988 | Horton | |
| 4,770,398 | A * | 9/1988 | Lee | 267/293 |
| 4,823,719 | A | 4/1989 | Sarwe | |
| 4,859,089 | A * | 8/1989 | Wright | 384/423 |
| 4,869,192 | A | 9/1989 | Pawolski | |
| 4,943,870 | A | 7/1990 | Sugishima | |
| 5,101,905 | A * | 4/1992 | Arlt et al. | 166/350 |
| 5,628,586 | A * | 5/1997 | Arlt, III | 405/195.1 |
| 5,683,206 | A | 11/1997 | Copple | |
| 5,823,131 | A | 10/1998 | Boatman et al. | |
| 6,019,055 | A | 2/2000 | Likitcheva | |
| 6,139,224 | A * | 10/2000 | Michel et al. | 405/224 |
| 6,161,620 | A | 12/2000 | Cox et al. | |
| 6,260,625 | B1 | 7/2001 | Phan et al. | |
| 6,263,824 | B1 | 7/2001 | Balint et al. | |

(Continued)

FOREIGN PATENT DOCUMENTS

JP 01-273783 11/1989

(Continued)

*Primary Examiner*—Thomas A Beach
(74) *Attorney, Agent, or Firm*—Klein, O'Neill & Singh, LLP; Howard Klein

(57) ABSTRACT

A floating offshore platform, of the type having a buoyancy can disposed within a support structure, includes a can guide assembly that has at least two compliant compression pads that are configured and arranged to provide a non-linear load-versus-deflection characteristic in response to impact loads generated by the impact of the can against the guide assembly. At least one of the compression pads is substantially stiffer (less compliant) than the other pad. The pads are arranged so that the relatively soft pad absorbs the impact load before the relatively stiff pad is engaged. In one embodiment, first, second, and third compression pads are arranged vertically, the upper and lower pads being softer (more compliant) than the middle pad. In another embodiment, a first, relatively soft, compression pad coaxially surrounds a second, relatively stiff compression pad.

42 Claims, 12 Drawing Sheets

U.S. PATENT DOCUMENTS 6,347,912 B1 2/2002 Thomas
6,352,116 B1 3/2002 Borseth
6,375,391 B1 4/2002 Borseth et al.
6,402,431 B1 6/2002 Nish
6,679,331 B1 * 1/2004 Cordy et al. ..... 166/367

FOREIGN PATENT DOCUMENTS

WO WO 200229206 * 4/2002

* cited by examiner

FIG. 19
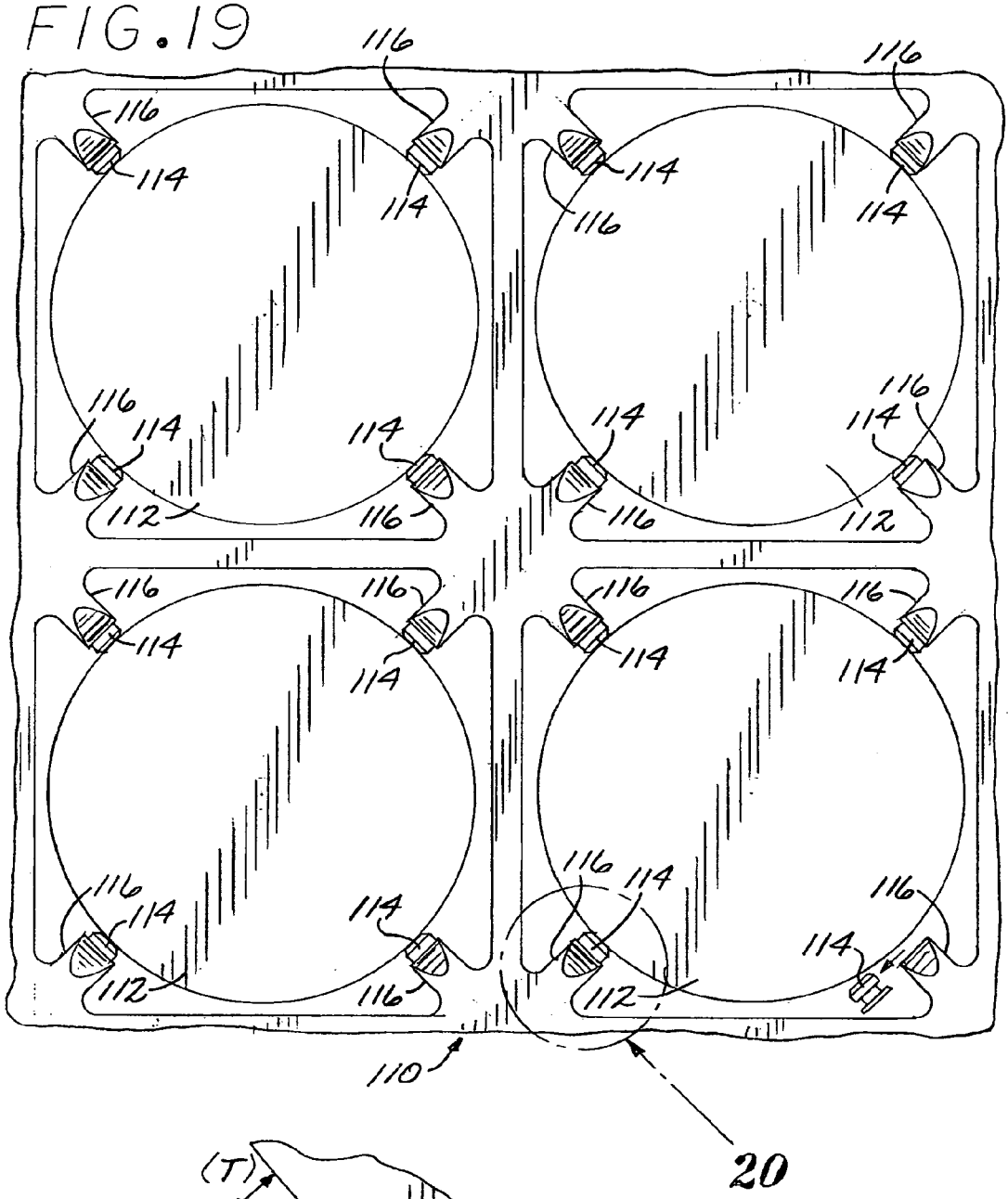
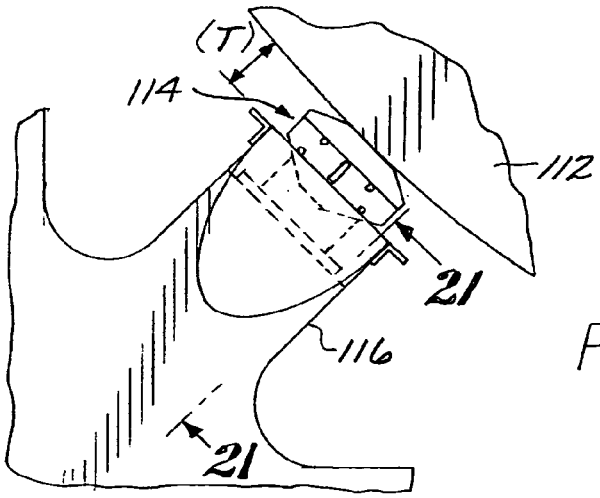
FIG. 20

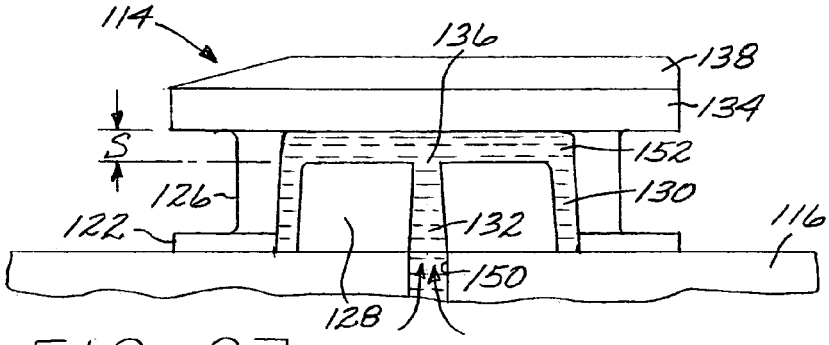
FIG. 27
FIG. 28
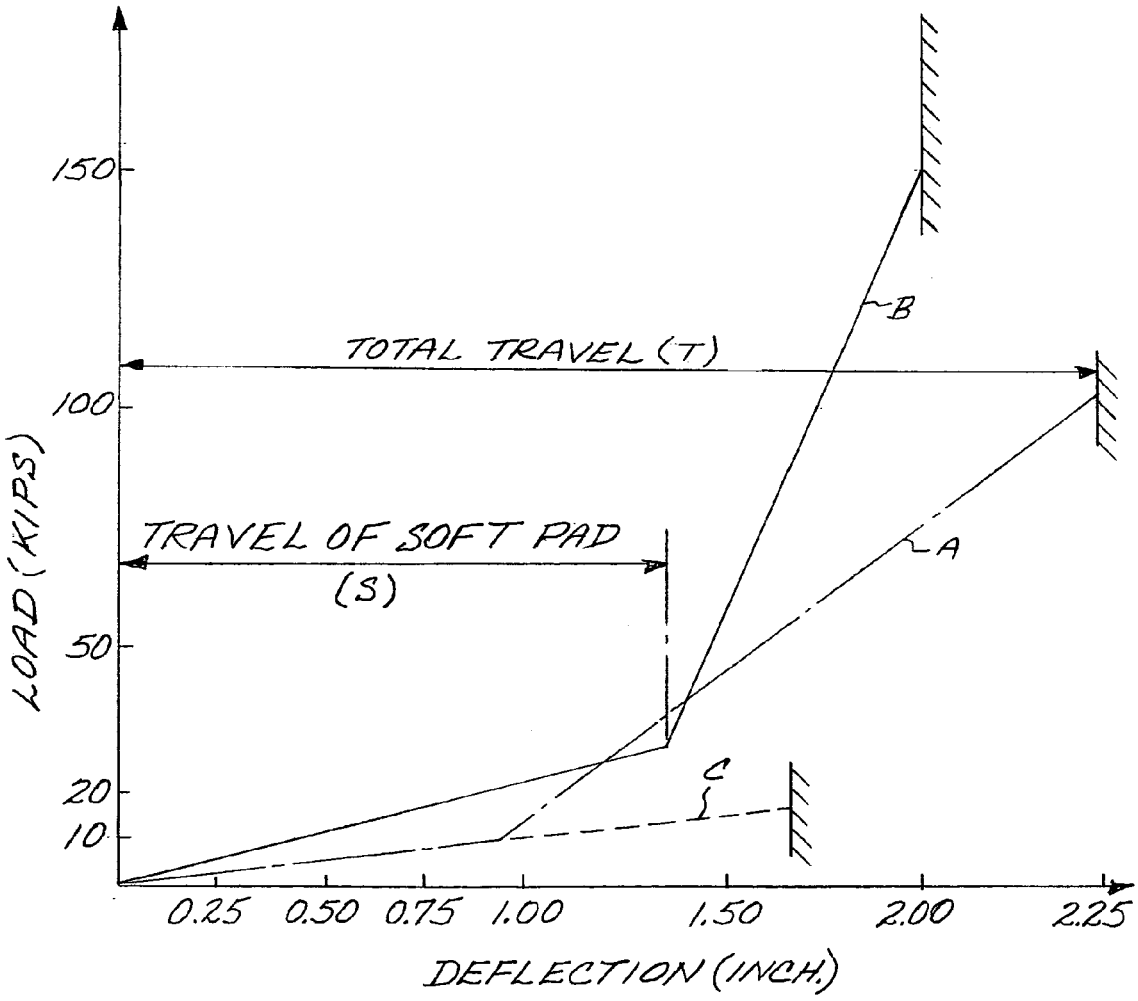

COMPLIANT BUOYANCY CAN GUIDE

CROSS-REFERENCE TO RELATED APPLICATIONS

This application is a continuation-in-part of application Ser. No. 09/850,599; filed May 7, 2001, now U.S. Pat. No. 6,679,331, the disclosure of which is incorporated herein by reference, which, in turn, claims the benefit, under 35 U.S.C. Section 119(e), of provisional application No. 60/283,240; filed Apr. 11, 2001, the disclosure of which is likewise incorporated herein by reference.

FEDERALLY SPONSORED RESEARCH OR DEVELOPMENT

Not applicable

BACKGROUND OF THE INVENTION

The present invention generally relates to floating offshore mineral exploration and production platforms and, more particularly, is concerned with a compliant guide for protecting the buoyancy cans and components of the floating offshore platform from damage from impacts that may occur as a result of hydrodynamic loads (e.g. Froude-Krylov impact forces) on the buoyancy cans.

The spacing between the buoyancy can outer wall and the contact point of the guide structure in the centerwell of a Spar type floating offshore mineral exploration and production platform has been found to be very important in determining loads on the buoyancy can. The buoyancy can will have contact points (most typically four to six), in the form of built-up wear strips. These contact points on the buoyancy can will face corresponding contact points on the guide structure. See U.S. Pat. No. 4,702,321 to Edward Horton for "Drilling, Production, and Oil Storage Caisson for Deep Water" and U.S. Pat. No. 4,740,109 to Edward Horton for "Multiple Tendon Compliant Tower Construction", both incorporated herein by reference.

Although sensitivity to gap size had previously been noticed in both model tests and in some calculations, efforts to determine the optimum gap size had assumed that once a small enough gap had been achieved, the nature and magnitude of the loads, including impact loads, would converge to those of a zero gap. Efforts were aimed at finding the point of diminishing returns on an exponential-type either load or bending moment response curve, where forces were determined without consideration for impact loads.

BRIEF SUMMARY OF THE INVENTION

Previous attempts to minimize the gap have been dependent on the tolerances that are achievable in fabricating buoyancy cans, guides, and supporting structures. Recent analytical and model test work has indicated that the conclusions made previously did not fully account for impact loads, and that the nature of the signal is quite different if there is a gap that is large enough for these fabrication tolerances. Loads on the buoyancy can and guide have been found to be large and numerous enough to make practical design for both strength and fatigue difficult. Therefore, there is a need to reduce loads, particularly impact loads, on buoyancy cans.

It has been found that the solution to the above-described problem involves the insertion of an additional flexible element between the guide, the guide support structure, and the buoyancy can. One result of such an insertion is reduction of the effective gap size. In some embodiments of the invention, therefore, the gap will be, effectively, zero, (potentially with some preload). Thus, the insert provides for practical fabrication tolerances. Since the gap size is small, the relative velocity at impact is also small. If the gap is effectively zero, the loads are roughly equivalent to the loads calculated using the closed gap assumption. Additionally, if there were to be an impact load, the stiffness of the connection is reduced, in some embodiments, by designing the compliant guide stiffness to meet load requirements.

Using a computer simulation program, loads on the guides were computed for a given random excitation for a number of gap sizes both with and without the compliant guide. Results for maximum load from these simulations are shown in FIG. 18. FIG. 18 clearly shows that the maximum loads for a given gap size are significantly reduced by the insertion of the flexible element, as compared to the previous rigid, steel-to-steel contact designs. FIG. 18 also shows that there is a benefit associated with use of a preload in some embodiments. However, in alternative embodiments, there is zero preload, since introduction of an unnecessarily high preload could potentially introduce other problems.

According to one exemplary embodiment of the invention, a guide for a buoyancy can on a floating offshore platform is provided. The platform includes at least one support structure adjacent the buoyancy can. The guide comprises at least one compliant guide member supported by the support structure adjacent the exterior surface of the buoyancy can. Lateral movement of the buoyancy can toward the support structure compresses the compliant member so as to absorb the force generated by the buoyancy can movement, and so as to protect the buoyancy can and components of the floating offshore platform from damage. A wear pad disposed between each guide structure and the buoyancy can protects the guide and buoyancy can from friction wear.

According to another exemplary embodiment of the invention, the support structure has at least one projection attached thereto. A buoyancy can guide is provided that comprises at least one elastomeric compression pad supported by the support structure and adjacent the exterior surface of the buoyancy can. Lateral movement of the buoyancy can toward the support structure compresses the elastomeric compression pad so as to absorb the force generated by the buoyancy can movement, and so as to protect the buoyancy can and components of the floating offshore platform from damage. A wear pad disposed between each elastomeric compression pad and the buoyancy can protects the compression pad from friction wear against the buoyancy can. At least one carriage is attached to the guide. The carriage has a channel therein that slidingly engages the projection on the support structure.

According to still another exemplary embodiment of the invention, the support structure has upper and lower projections attached thereto. A buoyancy can guide is provided that comprises a plurality of elastomeric compression pads supported by the support structure and adjacent the exterior surface of the buoyancy can. Each compression pad has first and second opposite sides. Lateral movement of the buoyancy can toward the support structure compresses the elastomeric compression pads so as to absorb the force generated by the buoyancy can movement, and so as to protect the buoyancy can and components of the floating offshore platform from damage. A first rigid plate is associated with the first side of the compression pad. A second rigid plate is disposed between and affixed to the support structure and the second side of the compression pad for affixing the compression pad to the support structure. A wear pad support is attached to the first rigid plate. The wear pad support has upper and lower ends and comprises a base plate, a pair of spaced side plates attached to and extending from the base plate, and a top plate extending between the side plates. A wear pad is secured to the wear pad support. The wear pad is disposed between the compression pad and the buoyancy can for protecting the compression pad and buoyancy can from friction wear. Upper and lower carriages extend from the upper and lower ends, respectively, of the wear pad support. Each carriage has a channel therein that slidingly engages a respective projection on the support structure.

According to yet another exemplary embodiment of the invention, the support structure has upper and lower projections attached thereto. A buoyancy can guide is provided that comprises a plurality of elastomeric compression pads supported by the support structure and adjacent the exterior surface of the buoyancy can. Each compression pad has first and second opposite sides. Lateral movement of the buoyancy can toward the support structure compresses the elastomeric compression pads so as to absorb the force generated by the buoyancy can movement, and so as to protect the buoyancy can and components of the floating offshore platform from damage. A bearing plate is affixed to the first side of the compression pad. A first rigid plate is affixed to the bearing plate. A second rigid plate is disposed between and affixed to the support structure and the second side of the compression pad for affixing the compression pad to the support structure. A wear pad support is attached to the first rigid plate. The wear pad support has upper and lower ends. The wear pad support comprises a base plate, a pair of spaced side plates attached to and extending from the base plate, and a top plate extending between the side plates. A wear pad is secured to the wear pad support. It is disposed between the compression pad and the buoyancy can for protecting the compression pad and buoyancy can from friction wear. Upper and lower carriages extend from the upper and lower ends, respectively, of the wear pad support. Each carriage has a channel therein that slidingly engages a respective projection on the support structure.

In one particular preferred embodiment, the compliant buoyancy can guide comprises a pair of nested elastomeric compression pads, that is, a first compression pad circumferentially surrounding a second compression pad. The first elastomeric compression pad is more compliant (i.e., less stiff) than the second pad, so that a non-linear load deflection response is achieved in a compact and cost-effective structure. For relatively small deflections, the compliant can guide of this design provides small loads, a result that is essential during the installation process, and that reduces stick-slip fatigue on the risers supported by the buoyancy cans. For relatively large deflections, this embodiment provides higher loads that reduce the fatigue loads on the buoyancy can and the platform.

According to still another exemplary embodiment of the invention, apparatus for compliantly guiding a buoyancy can on a floating offshore platform is provided. The apparatus comprises a plurality of spaced support structures attached to the platform and arranged radially around the exterior circumferential surface of the buoyancy can. At least one elastomeric compression pad is attached to each support structure and disposed adjacent the exterior surface of the buoyancy can. Lateral movement of the buoyancy can toward one of the support structures compresses the elastomeric compression pad attached thereto so as to absorb the force generated by the buoyancy can movement, and so as to protect the buoyancy can and components of the floating offshore platform from damage.

According to a further exemplary embodiment of the invention, for a floating offshore platform having at least one buoyancy can and a support structure adjacent the buoyancy can, a method is provided for protecting the buoyancy can and the support structure from damage caused by impact of the buoyancy can with the support structure. The method comprises supporting at least one compliant member between the buoyancy can and the support structure. The method further comprises absorbing the force generated by lateral movement of the buoyancy can by compressing the compliant member between the buoyancy can and the support structure.

According to still another exemplary embodiment of the invention, for a floating offshore platform having at least one buoyancy can, a support structure for supporting a compliant guide for the buoyancy can is provided. The support structure comprises a T-girder and means for supporting the guide from the support structure.

BRIEF DESCRIPTION OF THE DRAWINGS

For a more complete understanding of the present invention, and the advantages thereof, reference is now made to the following Detailed Description of the Invention taken in conjunction with the accompanying drawings, in which:

FIG. 19 is a lateral cross-sectional view of a spar-type floating offshore mineral exploration and production platform having compliant buoyancy can guides and support structures in accordance with a second preferred embodiment of the present invention.

FIG. 20 is a detailed of the portion of FIG. 19 contained within the dashed circle 20 of FIG. 19.

FIG. 27 is a diagrammatic cross-sectional view of a compliant buoyancy can guide in accordance with the second preferred embodiment of the invention, showing the flow of water between the nested elastomeric elements.

FIG. 28 is a graphical representation of the load versus deflection characteristics of the compliant buoyancy can guide in accordance with the second preferred embodiment of the present invention, along with load versus deflection curves for typical prior art devices.

DETAILED DESCRIPTION OF THE INVENTION

Figure 1:
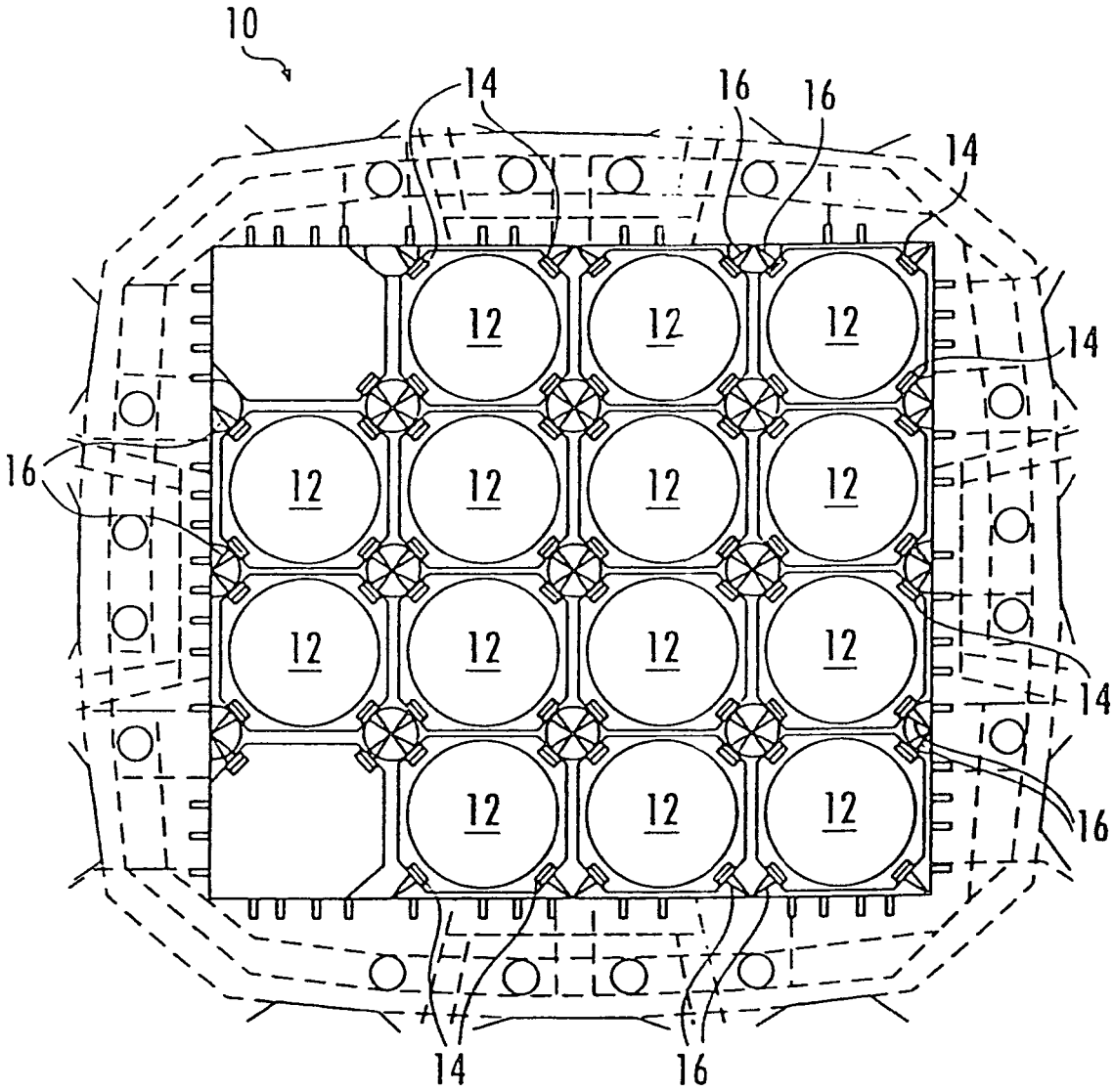
FIG. 1 is a lateral cross-sectional view of a spar-type floating offshore mineral exploration and production platform having compliant buoyancy can guides and support structures in accordance with a first preferred embodiment of the present invention.

In FIG. 1, there is shown, in a lateral cross-sectional view, a spar-type floating offshore mineral exploration and production platform, generally designated 10. In this example, the platform 10 includes a plurality of cylindrical buoyancy cans 12. A plurality of compliant guides 14 are spaced around the exterior circumferential surface of each buoyancy can 12. Although FIG. 1 shows four compliant guides 14 for each buoyancy can 12, it will be understood that more or fewer guides 14 may be used. The platform 10 in the present example also includes a plurality of support structures 16 to which the compliant guides 14 are attached. Examples of buoyancy cans 12, compliant guides 14, and support structures 16 are more clearly seen in FIG. 2, and will be more fully described below.

Figure 3:
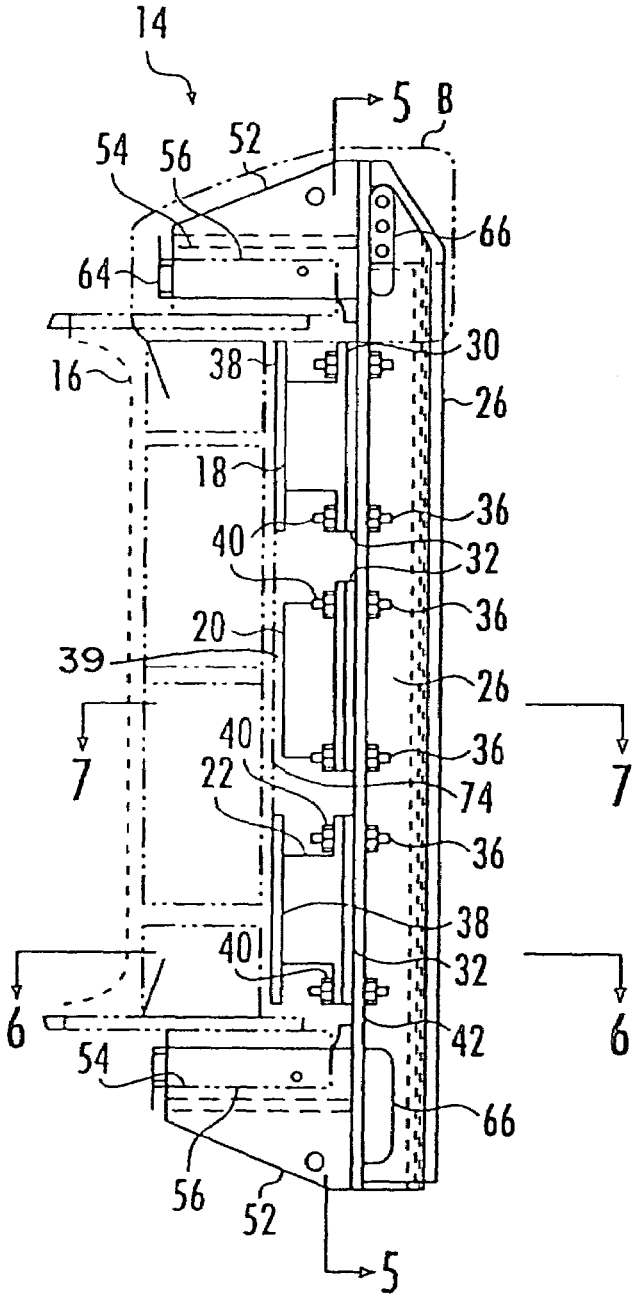
FIG. 3 is an elevation view of the compliant guide of the present invention taken along line 3—3 in FIG. 2.

Referring now to FIG. 3, the illustrated exemplary compliant guide 14 includes three vertically spaced elastomeric compression pads 18, 20, and 22. Lateral movement of the buoyancy can 12 (not shown in FIG. 3) toward support structure 16 compresses the elastomeric compression pads 18, 20, and 22 so as to absorb the force generated by buoyancy can 12 movement. The buoyancy can 12 and the components of the floating offshore platform 10 are thus protected from impact damage. In some embodiment, upper and lower compression pads 18 and 22 are relatively soft, and the middle compression pad 20 is relatively stiff.

Figure 4:
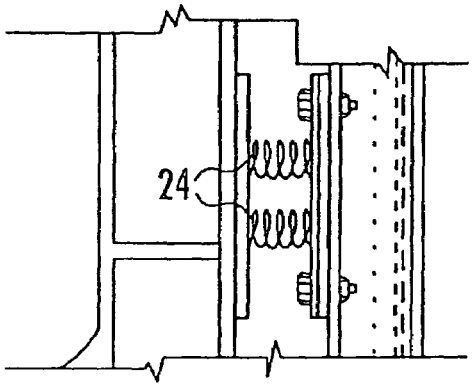
FIG. 4 is a partial elevation view taken along line 3—3 in FIG. 2, in which an elastomeric compression pad is replaced by helical compression springs.
Figure 17:
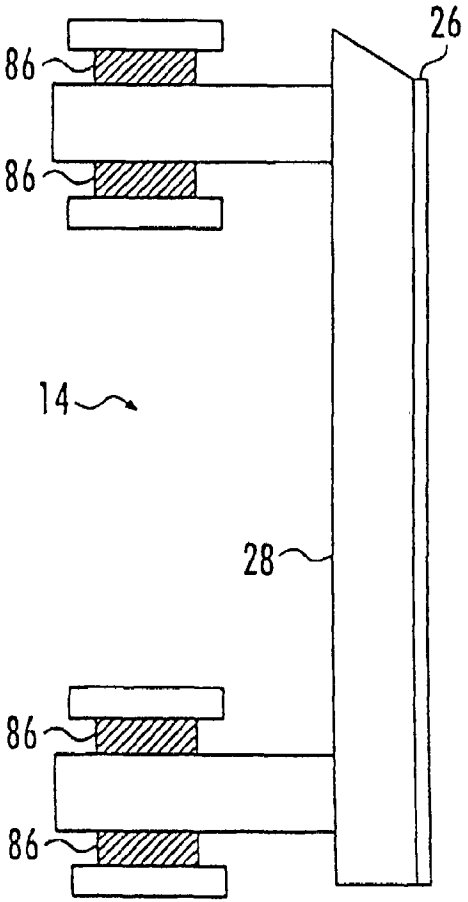
FIG. 17 is a partial elevation view taken along line 3—3 in FIG. 2, in which the elastomeric compression pads are replaced by elastomeric shear pads.
Figure 16:
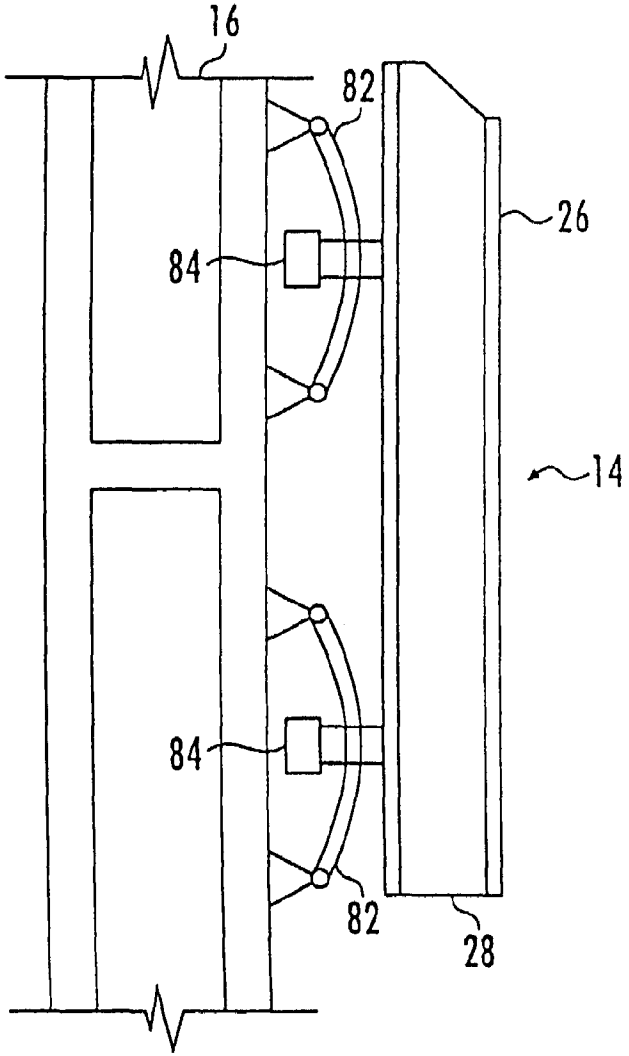
FIG. 16 is a partial elevation view taken along line 3—3 in FIG. 2, in which the elastomeric compression pads are replaced by leaf springs.
Figure 18:
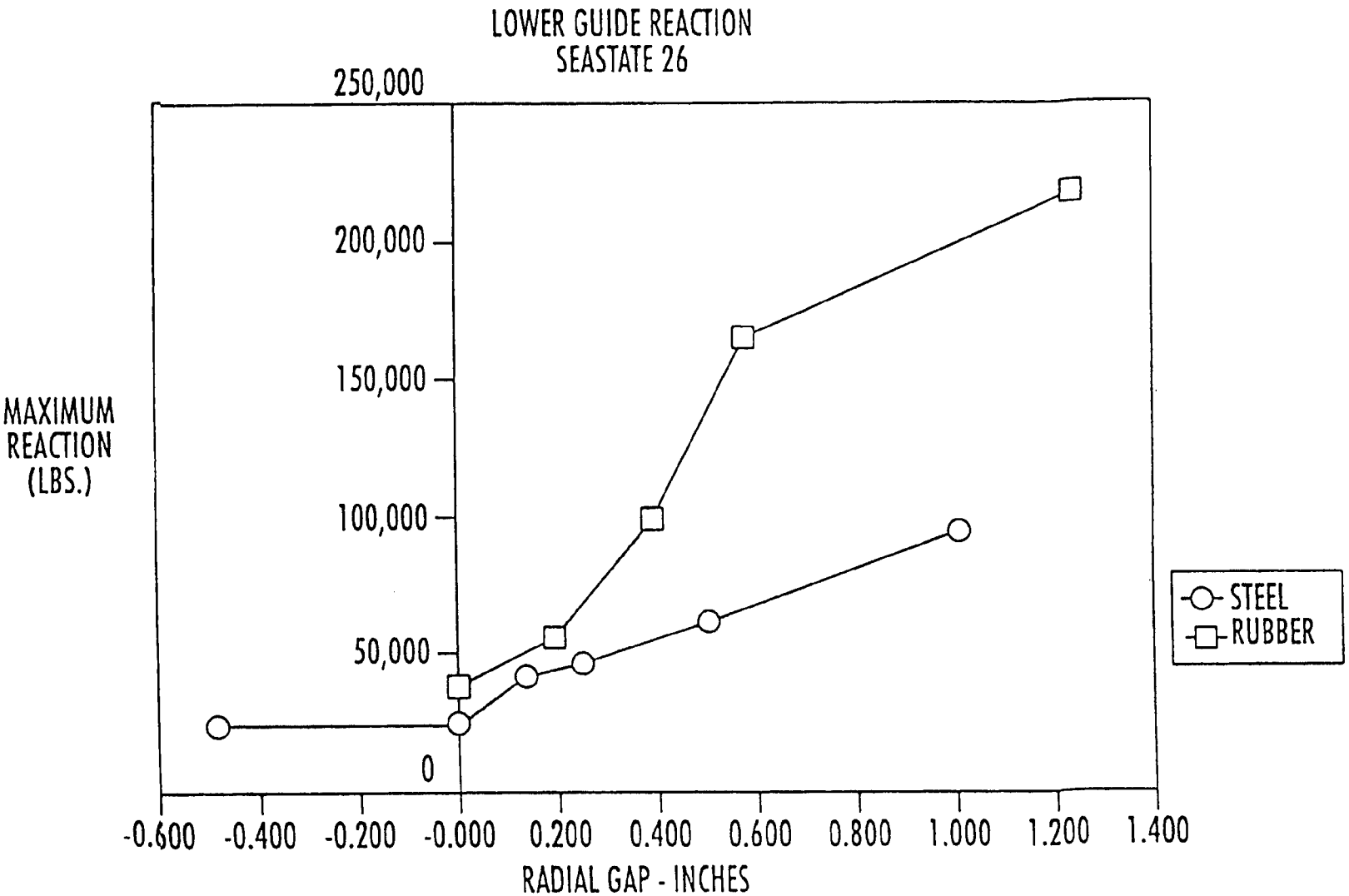
FIG. 18 is a graph depicting maximum load reaction on both compliant (rubber) and non-compliant (steel) guides for random excitations of the buoyancy can over a range of buoyancy can-to-guide radial gap sizes.

Other combinations of different elastomeric stiffnesses, or the use of spring components with different spring constants, will occur to those of skill in the art. For example, a spring or other compliant member is used in alternate embodiments instead of the elastomeric compression pads 18, 20, and 22 to absorb the force generated by movement of the buoyancy can 12. FIG. 4 is a partial view of an exemplary compliant guide 14 having a pair of helical compression springs 24 instead of an elastomeric compression pad. FIG. 16 is a partial view of a compliant guide 14 in which leaf springs 82 absorb the force generated by movement of the buoyancy can 12. In this embodiment, stops 84 limit the extent of displacement of the guide 14 toward the support structure 16. In different embodiments, the leaf springs 82 are made of steel or other suitable metallic material, e.g., titanium. FIG. 17 is a partial view of a compliant guide 14 in which elastomeric shear pads 86 absorb the force generated by movement of the buoyancy can 12. In other embodiments, the force generated by movement of the buoyancy can 12 is absorbed by pneumatic cylinders, hydraulic cylinders, an accumulator cylinder, or an air/elastomer device.

Figure 6:
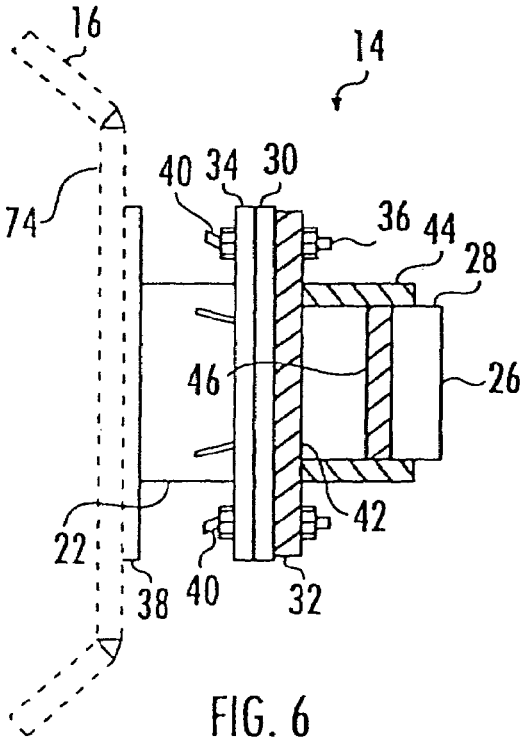
FIG. 6 is a cross-sectional view taken along line 6—6 in FIG. 3.
Figure 7:
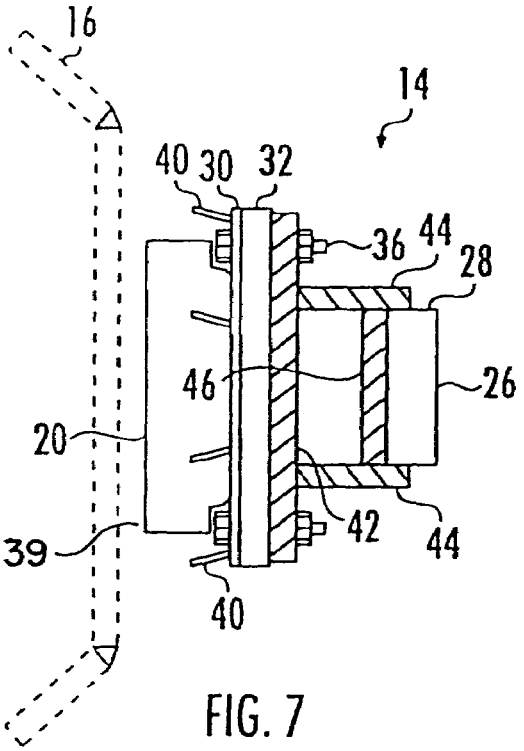
FIG. 7 is a cross-sectional view taken along line 7—7 in FIG. 3.

Referring next to FIGS. 6 and 7, the compliant guide 14 in the illustrated embodiment includes a wear pad 26 disposed between each compression pad 18, 20, and 22, and the buoyancy can 12 (not shown in FIGS. 6 and 7) for minimizing the friction between the compliant guide 14 and the buoyancy can 12, and for protecting the compression pads 18, 20, and 22 from friction wear against the buoyancy can 12. In some embodiments, the wear pad 26 is preferably made of ultra-high molecular weight (UHMW) polyethylene, or an equivalent polymeric material. In other embodiments, the wear pad 26 is made of steel or other ferrous or non-ferrous metal, nylon, Delryn, or other low friction material. In a more specific embodiment, the wear pad 26 is made of steel of a different hardness than that of the buoyancy can 12. Other suitable wear and/or friction reduction materials that may be used for the wear pad 26 will occur to those of skill in the art. A wear pad support 28 secures the wear pad 26 with respect to the compression pads 18, 20, and 22.

In some embodiments, a bearing plate and pad retainer 30 is affixed to the first side of the compression pads 18, 20, and 22. A first rigid plate 32 is affixed to the side of the bearing plate 30 opposite each of the compression pads 18, 20, and 22. The wear pad support 28 is attached to the sides of the first rigid plates 32 opposite the bearing plates 30. For the upper and lower compression pads 18 and 22, junction plates 34 are affixed to the bearing plates 30 near their outer edges. The wear pad support 28 is removably attached to the first rigid plate 32, the bearing plate 30, and the junction plate 34 by means such as bolts 36 or other suitable mechanical fasteners, or by welding. A second rigid plate 38 is disposed between, and affixed to, the support structure 16 and the second side of the upper and lower compression pads 18 and 22, respectively, for affixing the upper and lower compression pads 18 and 22, respectively, to the support structure 16, as shown in FIGS. 3 and 6, whereby a gap 39 is provided between the middle compression pad 20 and the support structure 16, as shown in FIGS. 3 and 7.

For each compression pad 18, 20, and 22, a retainer basket 40 extends out from the bearing plate 30 adjacent to the sides of the compression pad for capturing and retaining the compression pad in the unlikely event that it becomes detached from its bearing plate 30. The retainer basket 40 also helps to distribute the bolting force equally around the bearing plate 30. Equal force distribution helps to avoid damaging the elastomeric pad.

Figure 8:
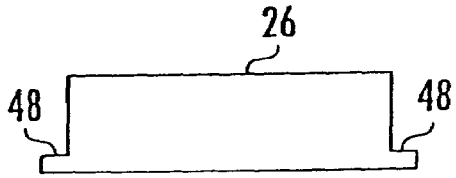
FIG. 8 is a cross-sectional view of the wear pad shown in FIGS. 6 and 7.
Figure 9:
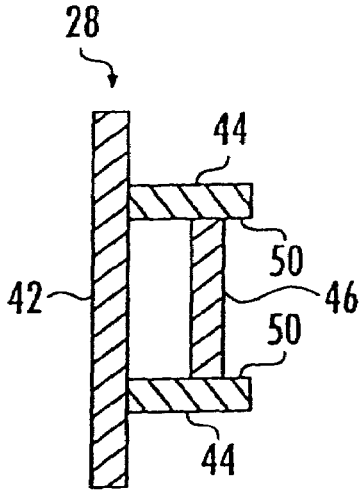
FIG. 9 is a cross-sectional view taken along line 9—9 in FIG. 3, in which the elastomeric compression pad is omitted for clarity.

In some embodiments, the wear pad support 28 comprises a base plate 42, a pair of spaced side plates 44 attached to and extending from the base plate 42, and a top plate 46 extending between the side plates 44. In some exemplary embodiments, the top plate 46 and the outer edges of side plates 44 form a receptacle for securing the wear pad 26 therein. Other suitable wear pad supports and structural components that may be used will occur to those of skill in the art. Referring to FIG. 8, longitudinal flanges 48 are formed in some embodiments on the opposite edges of the wear pad 26. Referring to FIG. 9, the side plates 44 of the wear pad support 28 include, in some embodiments, corresponding longitudinal grooves 50 for receiving the wear pad flanges 48 for retaining the wear pad 26 on the wear pad support 28.

Figure 5:
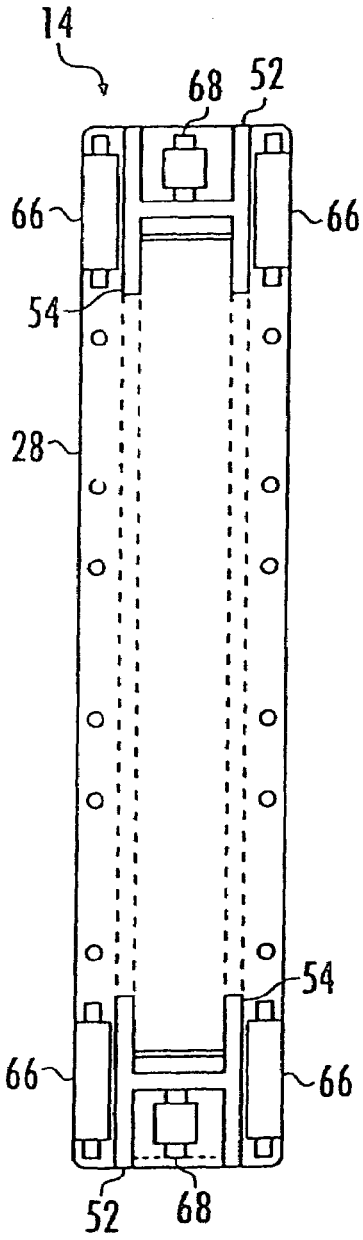
FIG. 5 is an elevation view taken along line 5—5 in FIG. 3, in which the elastomeric compression pads are omitted for clarity.
Figure 10:
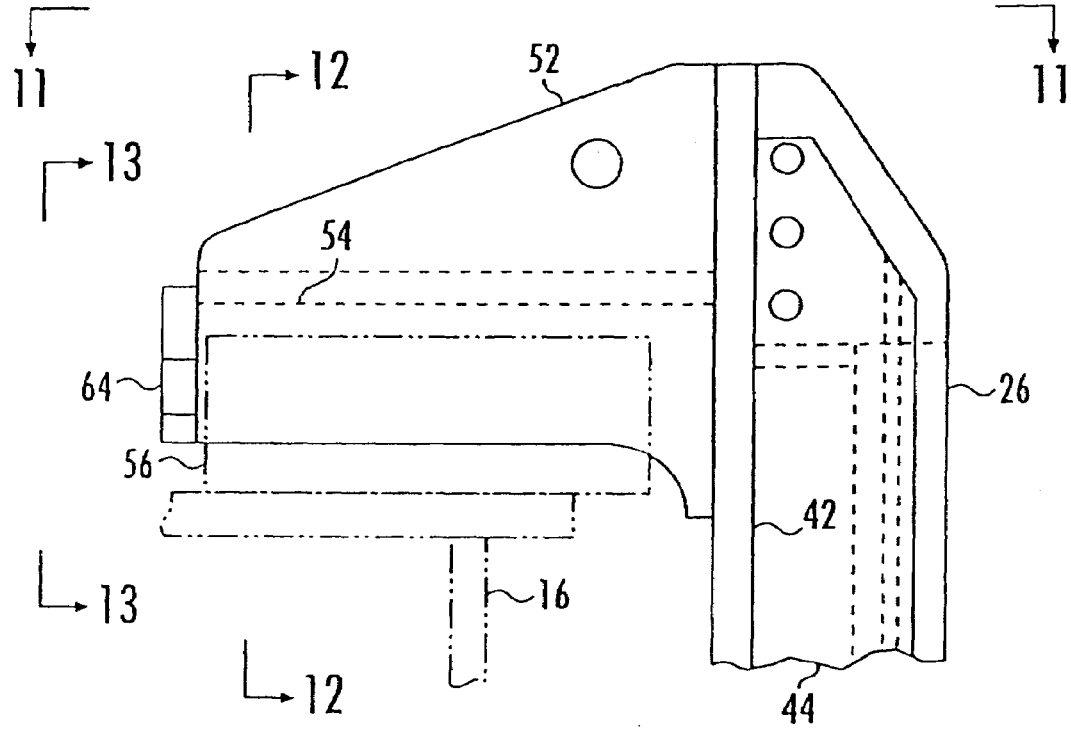
FIG. 10 is an enlarged, detail elevation view of the encircled portion of the compliant guide of FIG. 3 designated "B".
Figure 11:
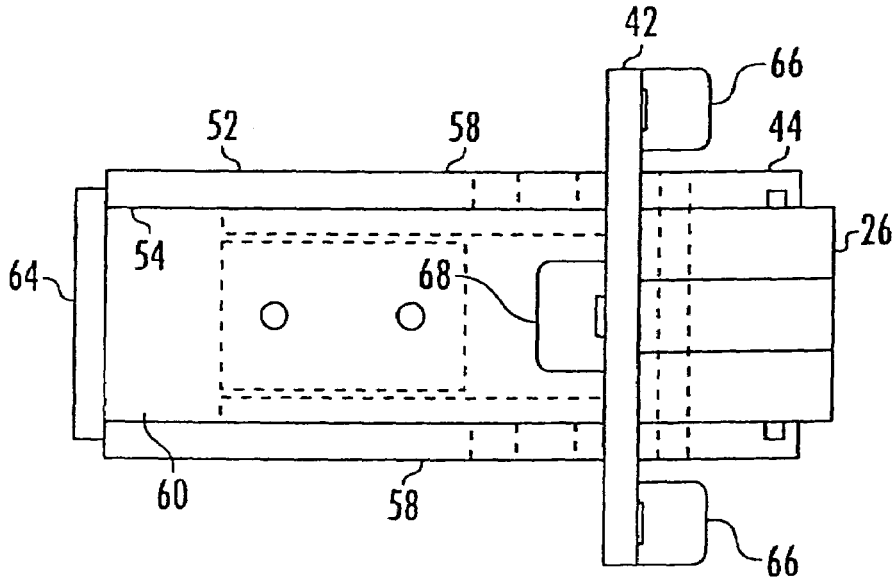
FIG. 11 is a cross-sectional view taken along line 11—11 in FIG. 10.

Referring to FIGS. 3 and 5, there is shown an exemplary means for supporting the compliant guide 14 from the support structure 16. In this example, a carriage 52 extends laterally from each end of the guide 14. A channel 54 in the carriage 52 slidingly engages a corresponding projection 56 attached to the support structure 16. FIGS. 10 and 11 illustrate a more detailed exemplary embodiment of the carriage 52 on the upper end of the guide 14.

Figure 12:
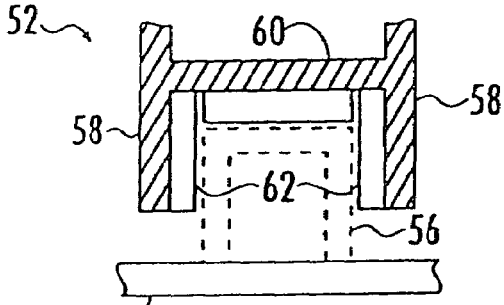
FIG. 12 is a cross-sectional view taken along line 12—12 in FIG. 10.

Referring to FIG. 12, the carriage 52 comprises, in some embodiments, a pair of spaced side plates 58 fastened to a bottom plate 60. A carriage wear pad 62 is affixed to each of the side plates 58 and to the bottom plate 60 of the carriage 52 for protecting the surfaces of the carriage 52 from friction wear against the projection 56. The wear pads 62 are preferably made of ultra high molecular weight (UHMW) polyethylene or an equivalent polymeric material, or other suitable wear material that will occur to those of skill in the art.

Figure 13:
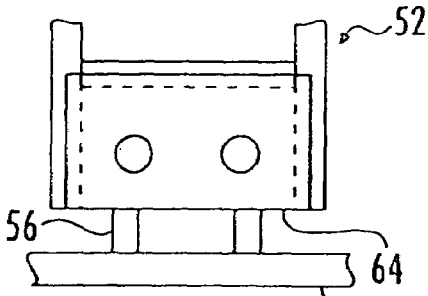
FIG. 13 is a cross-sectional view taken along line 13—13 in FIG. 10.

FIG. 13 illustrates an exemplary embodiment in which an end plate 64 is fastened to the outer end of the carriage 52 to retain the projection 56 within the channel 54 of the carriage 52, and thus retain the compliant guide 14 on the support structure 16.

Referring to FIGS. 3, 5, and 11, a pair of anodes 66 and a cathode 68 may advantageously be fixed to each end of the wear pad support 28 for cathodic protection of the guide assembly from corrosion in seawater.

In some embodiments, the compression pads 18, 20, and 22 are made of an elastomeric compound. In other embodiments, the compression pads 18, 20, and 22 are replaced by helical or leaf springs, air or liquid filled bumpers, or other passive or active compliant elements that provide increased force with increased displacement. The bearing plates 30, the first and second rigid plates 32 and 38, respectively, the junction plates 34, the base plates 42, the side plates 44, the top plates 46, the side plates 58, the bottom plates 60, and the end plates 64 preferably made of rigid steel plate.

Figure 2:
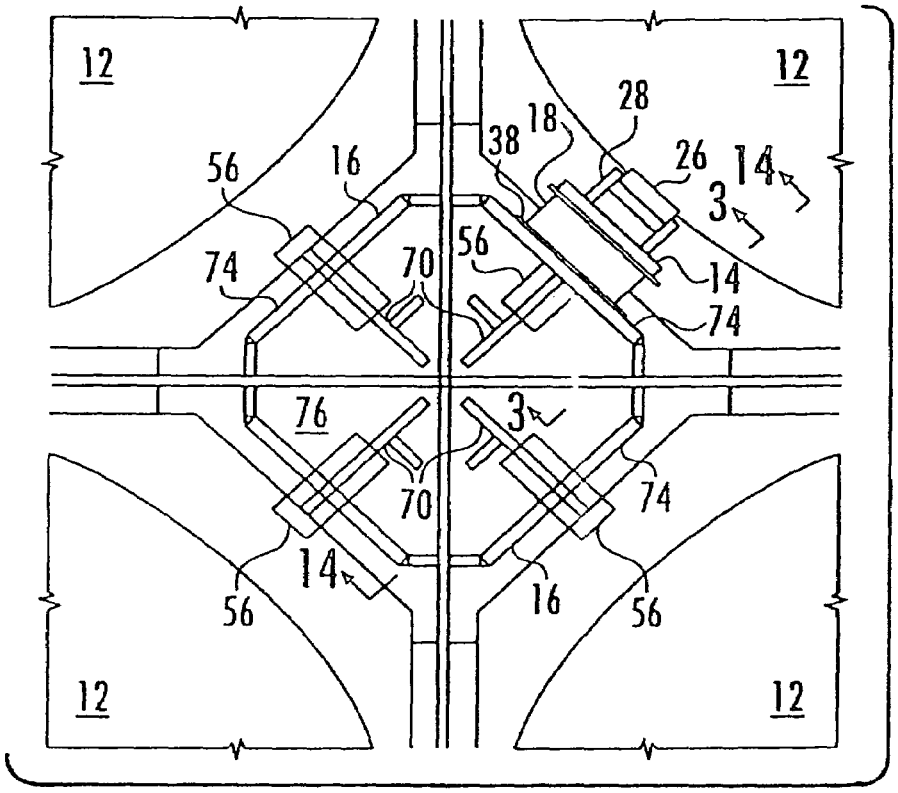
FIG. 2 is an enlarged, detail view of a portion of the platform of FIG. 1.
Figure 15:
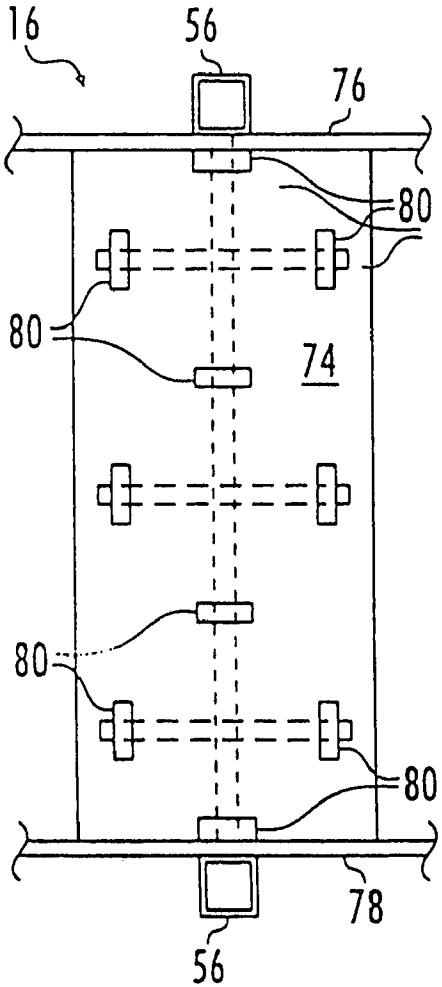
FIG. 15 is an elevation view taken along line 15—15 in FIG. 14.
Figure 14:
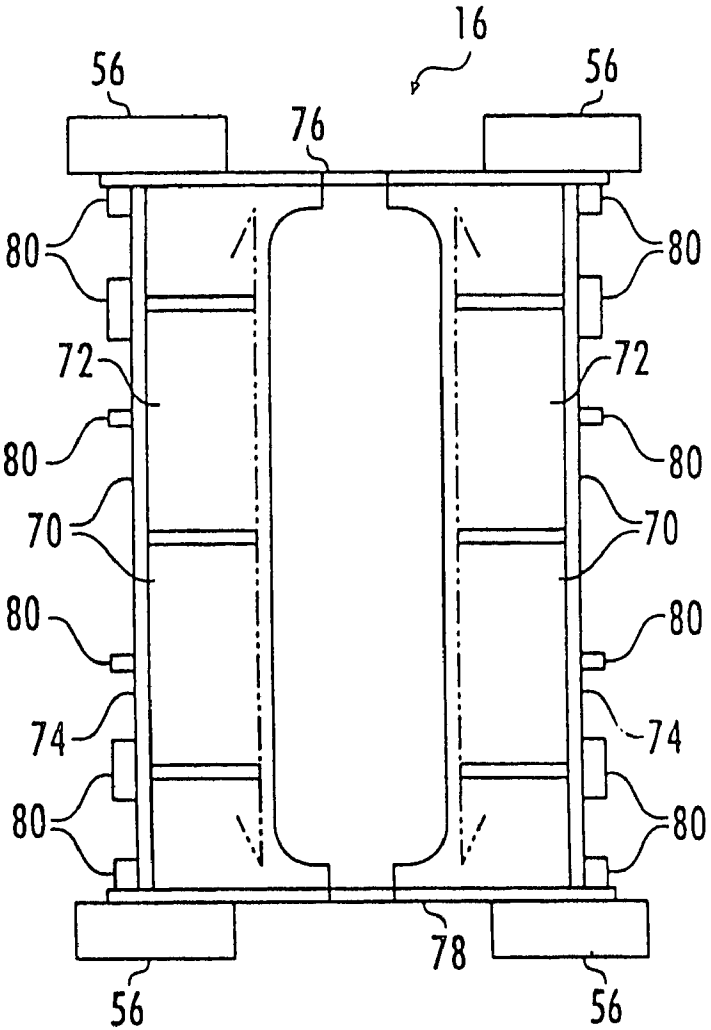
FIG. 14 is an elevation view of the support structure of the present invention taken along line 14—14 in FIG. 2.

FIGS. 2, 14 and 15 illustrate exemplary support structures 16 for supporting the compliant guide 14. The support structure 16 in some embodiments comprises a T-girder 70, which is made up of a web 72 and a face plate 74. An upper plate 76 is secured to the upper end of the T-girder 70, and a lower plate 78 is secured to the lower end of the T-girder 70. The projection 56 attached to the upper plate 76 slidingly engages the upper carriage 52 of the compliant guide 14 for supporting the guide 14 from the support structure 16. The projection 56 attached to the lower plate 78 slidingly engages the lower carriage 52 of the compliant guide 14 for further supporting the guide 14 from the support structure 16. The projections 56 comprise, in some embodiments, square steel tubes welded to the upper and lower plates 76 and 78. The T-girder 70 and the upper and lower plates 76 and 78, respectively, are preferably made of steel.

As seen in FIGS. 2, 3, 6, and 15, the second rigid plates 38 of the compliant guides 14 are secured to the face plate 74 of the T-girder 70. As seen in FIGS. 14 and 15, a plurality of rigid steel bars 80 are attached to the face plate 74 of the T-girder 70 adjacent the edges of the upper and lower compression pads 18 and 22 (not shown in FIGS. 14 and 15) for assisting in retaining the upper and lower compression pads 18 and 22 in their positions on the face plate 74. It will be understood that other types of compression pad retaining members known to those skilled in the art may be used instead of the rigid steel bars 80.

FIGS. 19 and 20 illustrate a spar-type platform 110 that includes a plurality of cylindrical buoyancy cans 112. A plurality of compliant buoyancy can guides 114, in accordance with a second preferred embodiment of the invention, are attached to support structures 116 in the platform. The guides 114 are arranged so that several guides 114 are located around the exterior of each of the buoyancy cans 112. While four guides 114 are shown equidistantly spaced around the circumference of each can 112, this number, though preferred, is not critical. The guides 114 are preferably removably attached to the support structures 116, by means such as bolts 120 (FIGS. 21 and 22), so that the guides can be removed and replaced as shown in the lower right hand corner of FIG. 19.

Referring to FIGS. 21 through 26, a compliant can guide 114 in accordance with this second embodiment is shown in detail. As used in the description below, the term "outer," when used in a directional context, shall mean in the direction away from the support structure 116, while the term "inner" shall mean in the direction toward the support structure 116.

Each guide 114 is a guide assembly that comprises a metal (e.g. steel) base plate 122 that is attached to the support structure 116, preferably by means such as bolts 120, as mentioned above. The base plate 122 is formed with a central aperture 124, and a first elastomeric compression pad 126 has a first or inner end that is fixed to the base plate 122 around the aperture 124. The first compression pad 126 has a circular, or preferably (as shown) an elliptical cross-sectional shape, defining a hollow core area in which a second elastomeric compression pad 128 is located. Preferably, the compression pads 126, 128 are arranged coaxially. The second compression pad 128 is seated in the central aperture 124 of the base plate 122 so that its inner end surface seats against the support structure 116. The outer diameter of the second compression pad 128 is measurably less than the inner diameter of the first compression pad 126, so that there is a peripheral channel 130 formed between the two pads. Also, the second compression pad 128 has a central axial bore 132.

The first compression pad 126 is formed of an elastomeric material that is less stiff (more compliant) than the material from which the second compression pad 128 is made, for reasons that will be explained below. Both compression pads may be made of a vulcanized natural rubber (latex) or any suitable synthetic elastomeric polymer that will readily suggest itself to those skilled in the pertinent arts.

Figure 25:
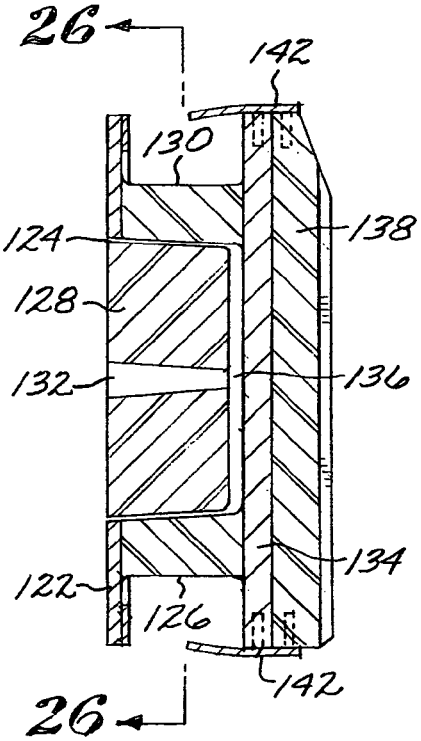
FIG. 25 is a cross-sectional view taken along line 25—25 of FIG. 23.
Figure 26:
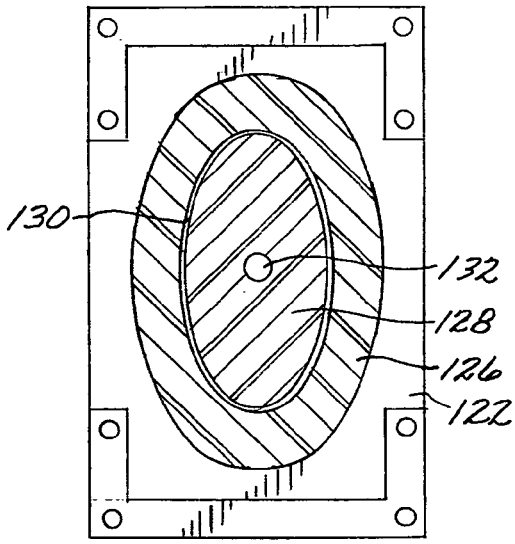
FIG. 26 is a cross-sectional view taken along line 26—26 of FIG. 25.

Secured to the outer end surface of the first compression pad 126, preferably by bonding, is a contact plate 134, preferably of steel. The respective axial dimensions of the first and second compression pads are such that there is a gap 136 between the outer end surface of the second compression pad 128 and the inner surface of the contact plate 134. As best shown in FIGS. 25 and 27, the axial bore 132 through the second compression pad 128 communicates with the gap 136, which, in turn, communicates with the peripheral channel 130 between the two compression pads 126, 128. As will be discussed below, the peripheral channel 130, the axial bore 132, and the gap 136 form a water passage for providing a damping effect.

The outer surface of the contact plate 134 is advantageously covered with a wear pad 138 that is preferably made of a durable, low-friction polymer, such as UHMW polyethylene. The wear pad 138 is advantageously provided with a longitudinal channel 140 that substantially prevents, or at least minimizes, the rotation of the buoyancy can 112 relative to the guide 114 when the wear pad 138 seats against the buoyancy can 112.

An end plate 142 may advantageously be secured to one or both of the upper and lower ends of the contact plate 134. Each end plate 142 extends inwardly toward the base plate 122. One or both of the end plates 142 may be secured to the base plate 122 by a bracket 144, as shown in FIG. 21, thereby providing metallic connectivity to inhibit corrosion.

Figure 21:
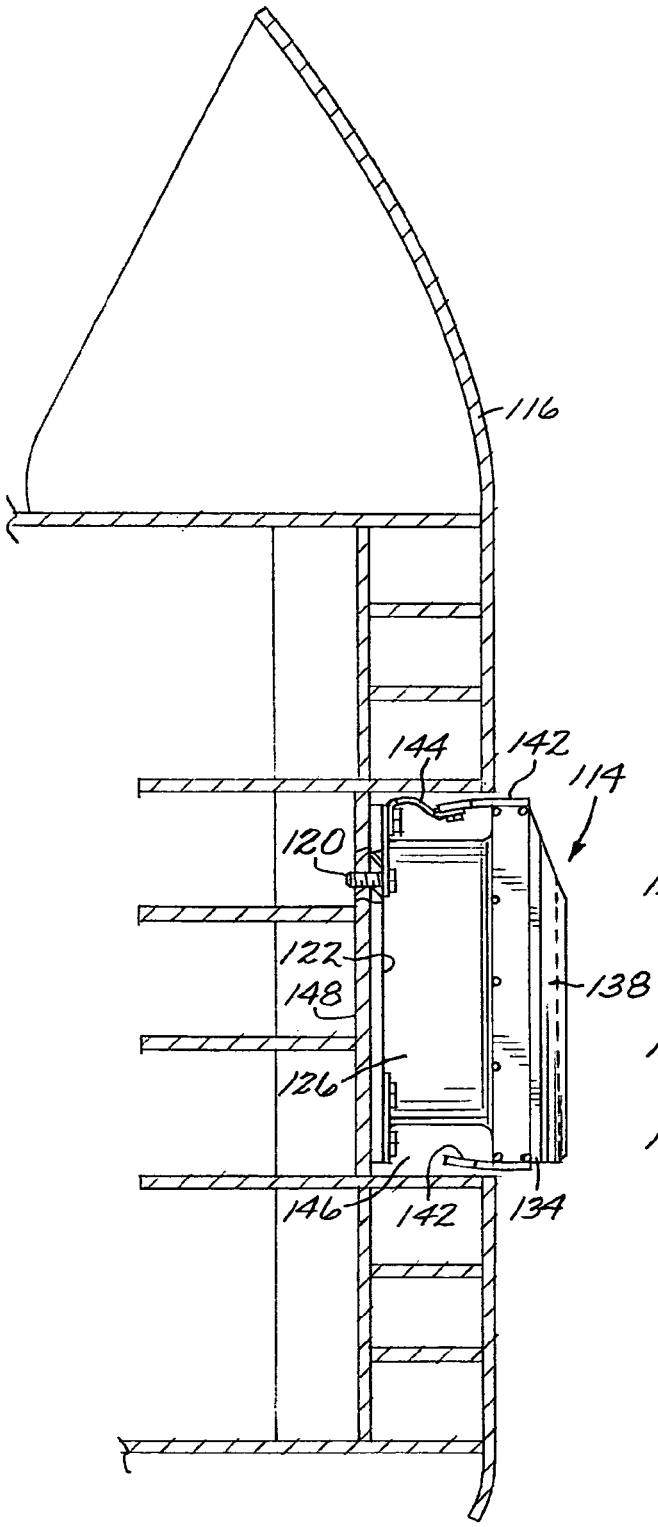
FIG. 21 is cross-sectional view taken along line 21—21 of FIG. 20.
Figure 22:
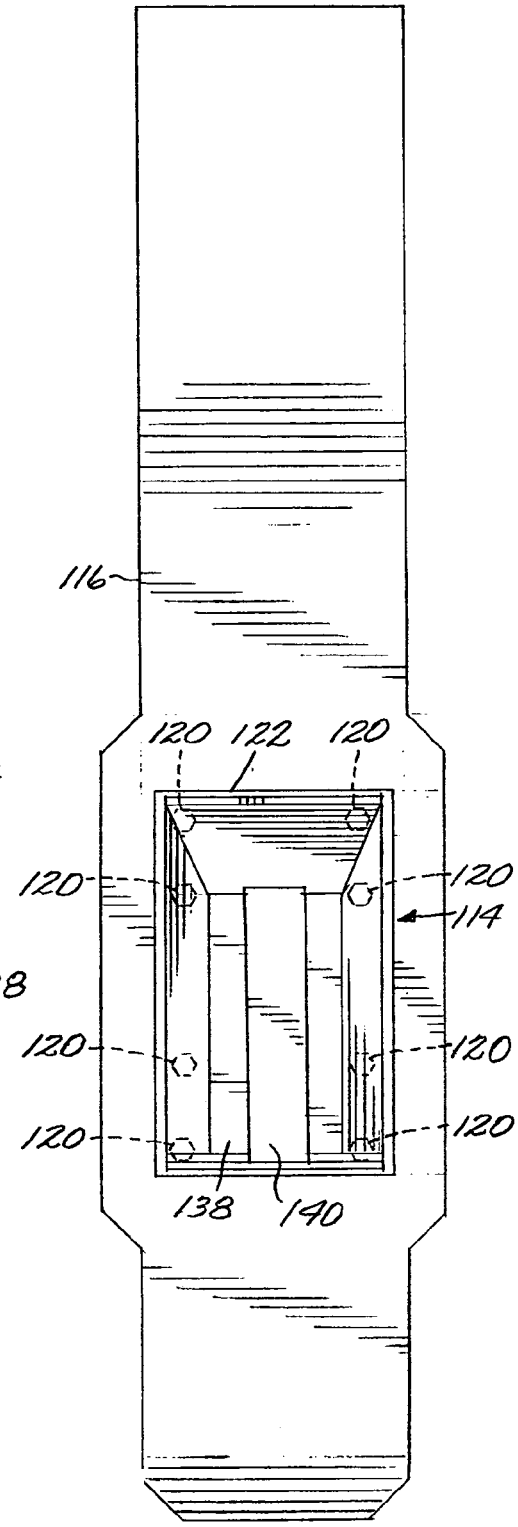
FIG. 22 is an elevational view taken from the right side of FIG. 21.
Figure 23:
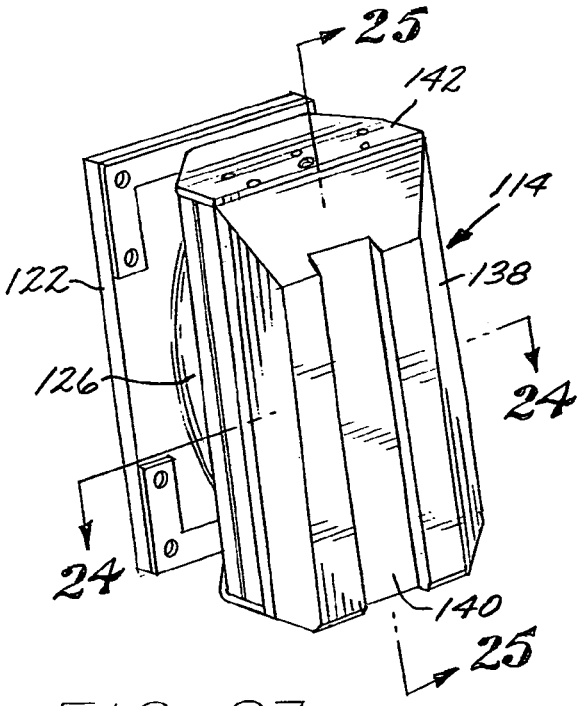
FIG. 23 is a perspective view of a compliant buoyancy can guide in accordance with the second preferred embodiment of the invention.
Figure 24:
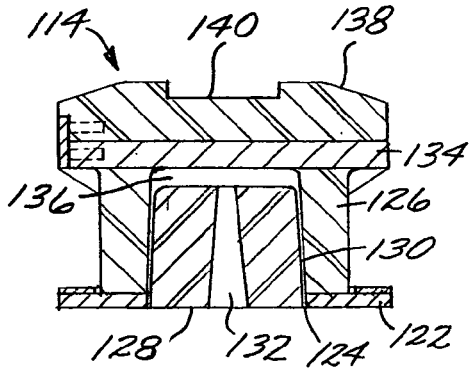
FIG. 24 is a cross-sectional view taken along line 24—24 of FIG. 23.

Also as shown in FIG. 21, the guide 114 is advantageously mounted within a recess 146 provided in the outer surface of the support structure 116. The inner surface of the recess 146 is provided by a mounting plate 148. As shown in FIG. 27, the mounting plate 148 has a central aperture 150. The base plate 122 of the guide 114 is secured to the mounting plate 148 so that the axial bore 132 of the second compression pad 128 communicates with the central aperture 150 of the mounting plate 148.

As also shown in FIG. 27 (in which the dimensions of the peripheral channel 130, the axial bore 132, and the gap 136 have been exaggerated for clarity), water 152 is allowed to pass through the central aperture 150 of the mounting plate 148 so as to flow into and out of the water passage formed by the axial bore 132, the gap 136, and the peripheral channel 134. The water provides a damping effect as the compression pads (especially the softer first compression pad 126) are respectively compressed and decompressed by the application and relief of the contact forces of the buoyancy can 112. This damping effect may be understood as a velocity-dependent stiffness response, in which the compliance of the guide assembly 114 decreases (gets "stiffer") as the velocity component of the impact load increases. The magnitude of the damping effect is determined by the diameter of the mounting plate aperture 150, and by the volume of water contained in the water passage.

The nesting of the stiffer second contact pad 128 within the softer first contact pad 126 provides a non-linear load deflection response in a compact and cost-effective structure. For relatively small deflections, the compliant can guide 114 of this second embodiment provides small loads, a result that is essential during the installation process, and that reduces stick-slip fatigue on the risers supported by the buoyancy cans. For relatively large deflections, this embodiment provides higher loads that reduce the fatigue loads on the buoyancy can and the platform. This non-linear response is illustrated in FIG. 28, which illustrates the load-versus-deflection performance of a specific exemplary guide constructed in accordance with the second embodiment of the invention (curve A), as contrasted with an exemplary guide constructed in accordance with the embodiment of FIG. 5 (curve B) and with an exemplary guide having only a compression pad of a single, uniform stiffness (curve C). (The term "non-linear," in the context of the present disclosure, means that the load-versus-deflection curve is not continuously linear between zero deflection and the extreme limit of deflection.)

In FIG. 28, curve A shows that the soft first compression pad 126 provides a load of about 10 kips at an initial deflection (labeled "S" in FIGS. 27 and 28) of slightly less than about 1 inch (2.54 cm), while the stiff second compression pad 128 provides a load of slightly more than 100 kips in response to a subsequent deflection of approximately 1.25 inches (3.18 cm), yielding a total deflection (labeled "T" in FIGS. 20 and 28) of about 2.25 inches (5.72 cm). In contrast, as shown in curve B, in an exemplary guide constructed in accordance with the embodiment of FIG. 5, the soft upper and lower compression pads 18, 22 provide a load of approximately 30 kips at an initial deflection of approximately 1.4 inches (3.56 cm), while the stiff middle compression pad 20 provides a load of approximately 150 kips in response to a subsequent deflection of approximately 0.6 inches (1.52 cm). Finally, as shown in curve C, in a typical prior art guide having a single compression pad of substantially uniform stiffness, the load-versus-deflection response is substantially continuously linear up to approximately 20 kips at a deflection of about 1.7 inches (4.32 cm).

It will, of course, be appreciated that any desired load-versus-deflection characteristic can be obtained by changing the geometry, dimensions, and/or material characteristics of the compression pads 126, 128. Furthermore, the geometry of the compression pads, particularly the softer first compression pad, is designed to provide the above-described non-linear load-versus-deflection characteristic without significant buckling.

The compliant buoyancy can guide, in accordance with the above-described embodiments of the present invention, will be understood from the foregoing description of exemplary embodiments, and it will be apparent that, although specific examples of the invention and their advantages have been described in detail, various modifications and alterations will occur to those of skill in the art. Such modifications and alterations should be considered equivalents to the structure specifically disclosed herein, and should therefore be considered to be within the spirit and scope of the invention, as defined by the appended claims.

What is claimed is:

1. A guide for a buoyancy can on a floating offshore platform, the platform including a support structure adjacent the buoyancy can, the guide comprising:

first and second elastomeric compression pads secured to the support structure so as to be adjacent to exterior surface of the buoyancy can, wherein the first compression pad is relatively soft, and to second compression pad is relatively stiff, wherein the first compression pad defines a hollow core area in which the second compression pad is nested.

2. The guide of claim 1, further comprising a base plate attached to the support structure, wherein the first compression pad has an inner end surface attached to the base plate.

3. The guide of claim 2, wherein the first compression pad has an outer end surface attached to a contact plate.

4. The guide of claim 3, wherein the second compression pad is separated from the first compression pad by a peripheral channel, and from the contact plate by a gap that communicates with the channel.

5. The guide of claim 3, wherein at least a substantial portion of the contact plate is covered by a wear pad of a durable, low-friction material.

6. The guide of claim 5, wherein the wear pad is made of UHMW polyethylene.

7. The guide of claim 4, wherein the second compression pad includes an axial bore that communicates with the channel and the gap to form a water passage.

8. The guide of claim 4, wherein the base plate has an aperture that allows the second compression pad to seat against the support structure, and wherein the first compression pad is attached to the base plate around the aperture.

9. The guide of claim 7, wherein the support structure includes an aperture, and wherein the guide is attachable to the support structure so as to place the support structure aperture in communication with the axial bore.

10. The guide of claim 5, wherein the wear pad has an exterior surface configured for contacting the exterior surface of the buoyancy can, wherein the exterior surface of the wear pad includes a longitudinal channel.

11. A guide for a buoyancy can on a floating offshore platform, the platform including a support structure adjacent the buoyancy can, the guide comprising:

first and second elastomeric compression pads mounted coaxially on the support structure adjacent the exterior surface of the buoyancy can, the first compression pad being substantially softer than the second compression pad, wherein the first compression pad defines a hollow core area in which the second compression pad is located; and a contact plate attached to a first side of the first compression pad and spaced from a first side of the second compression pad by a gap.

12. The guide of claim 11, wherein the contact plate has a first side attached to the first compression pad and a second side to which is attached a wear pad.

13. The guide of claim 12, wherein the wear pad is made of UHMW polyethylene.

14. The guide of claim 11, further comprising a base plate that is removably attachable to the support structure, wherein the first compression pad is attached to the base plate round the second compression pad.

15. The guide of claim 14, wherein the base plate has a central aperture that allows the second compression pad to seat directly against the support structure, and wherein the first compression pad is attached to the base plate around the aperture.

16. The guide of claim 11, wherein the first and second compression pads are separated from each other by a peripheral channel that is in communication with the gap.

17. The guide of claim 16, wherein the second compression pad includes an axial bore that communicates with the gap to form a water passage with the gap and the peripheral channel.

18. The guide of claim 17, wherein the base plate has a central aperture that allows the second compression pad to seat directly against the support structure, wherein the first compression pad is attached to the base plate round the aperture, and wherein the support structure has an aperture located so that the support structure aperture is in communication with the axial bore when the guide is attached to the support structure.

19. A compliant guide assembly for reducing impact loads on a buoyancy can from a support structure in a floating offshore platform, the guide assembly comprising:

a base plate removably attachable to the support structure;

a first, relatively soft compression pad having an inner end attached to the base plate and an outer end, the first compression pad defining a hollow core area;

a second, relatively stiff compression pad located within the hollow core area of the first compression pad and separated from the first compression pad by a peripheral channel; and a contact plate attached to the second end of the first compression pad and separated from the second compression pad by a gap that is in communication with the peripheral channel.

20. The compliant guide assembly of claim 19, wherein the first and second compression pads are made of elastomeric material.

21. The compliant guide assembly of claim 19, wherein the contact plate has a first side attached to the first compression pad and a second side to which is attached a wear pad.

22. The compliant guide assembly of claim 21, wherein the wear pad is made of UHMW polyethylene.

23. The compliant guide assembly of claim 19, wherein the first compression pad is attached to the base plate around the second compression pad.

24. The compliant guide assembly of claim 19, wherein the second compression pad includes an axial bore that communicates with the gap to form a water passage with the gap and the peripheral channel.

25. The compliant guide assembly of claim 19, wherein the base plate has a central aperture that allows the second compression pad to seat directly against the support structure, wherein the first compression pad is attached to the base plate around the aperture, and wherein the support structure has an aperture located so that the support structure aperture is in communication with the axial bore when the guide is attached to the support structure.

26. A compliant guide assembly for reducing impact loads on a buoyancy can from a support structure in a floating offshore platform, the guide assembly comprising:

first and second elastomeric compression pads mounted on the support structure adjacent the exterior surface of the buoyancy can, the positioning of the first and second compression pads and their relative stiffnesses being such as to provide non-linear load-versus-deflection performance in response to impact loads created by the impact of the buoyancy can against the guide assembly; wherein the first compression pad is substantially less stiff than the second compression pad; wherein the first and second compression pads are arranged so that the first compression pad undergoes an initial deflection in response to an impact load before the second compression pad is deflected in response to the impact load; and wherein the first and second compression pads are arranged coaxially, with the second compression pad contained within a central core area defined within the first compression pad.

27. The compliant guide assembly of claim 26, further comprising a base plate configured to be secured to the support structure, wherein the first compression pad has an inner end surface that is attached to the base plate.

28. The compliant guide assembly of claim 27, wherein the first compression pad has an outer end surface, and wherein the assembly further comprises a contact plate attached to the outer end surface of the first compression pad so as to be spaced from the second compression pad by a gap.

29. The compliant guide assembly of claim 28, further comprising a wear pad made of a durable, low-friction polymer attached to the contact plate.

30. The compliant guide assembly of claim 27, wherein the base plate has a central aperture that allows the second compression pad to seat directly against the support structure, and wherein the first compression pad is attached to the base plate around the aperture.

31. The compliant guide assembly of claim 28, wherein the first and second compression pads are separated from each other by a peripheral channel that is in communication with the gap.

32. The compliant guide assembly of claim 31, wherein the second compression pad includes an axial bore that communicates with the gap to form a water passage with the gap and the peripheral channel.

33. The compliant guide assembly of claim 32, wherein the base plate has a central aperture that allows the second compression pad to seat directly against the support structure, wherein the first compression pad is attached to the base plate around the aperture, and wherein the support structure has an aperture located so that the support structure aperture is in communication with the axial bore when the guide is attached to the support structure.

34. A compliant guide assembly for reducing impact loads on a buoyancy can from a support structure in a floating offshore platform, the guide assembly comprising:

first and second elastomeric compression pads mounted on the support structure adjacent the exterior surface of the buoyancy can, the positioning of the first and second compression pads and their relative stiffnesses being such as to provide non-linear load-versus-deflection performance in response to impact loads created by the impact of the buoyancy can against the guide assembly; wherein the first compression pad is substantially less stiff than the second compression pad; wherein the first and second compression pads are arranged so that the first compression pad undergoes an initial deflection in response to an impact load before the second compression pad is deflected in response to the impact load; and a third compression pad, wherein the first, second, and third compression pads are arranged vertically, wherein the first and third compression pads are softer than the second compression pad, and wherein the first, second, and third compression pads are arranged so that the first and third compression pads undergo an initial deflection in response to an impact load before the second compression pad is deflected in response to the impact load.

35. The compliant guide assembly of claim 34, wherein the first and second compression pads are arranged coaxially, with the second compression pad contained within a central core area defined within the first compression pad.

36. The compliant guide assembly of claim 35, further comprising a base plate configured to be secured to the support structure, wherein the first compression pad has an inner end surface that is attached to the base plate.

37. The compliant guide assembly of claim 36, wherein the first compression pad has an outer end surface, and wherein the assembly further comprises a contact plate attached to the outer end surface of the first compression pad so as to be spaced from the second compression pad by a gap.

38. The compliant guide assembly of claim 37, further comprising a wear pad made of a durable, low-friction polymer attached to the contact plate.

39. The compliant guide assembly of claim 36, wherein the base plate has a central aperture that allows the second compression pad to seat directly against the support structure, and wherein the first compression pad is attached to the base plate around the aperture.

40. The compliant guide assembly of claim 37, wherein the first and second compression pads are separated from each other by a peripheral channel that is in communication with the gap.

41. The compliant guide assembly of claim 40, wherein the second compression pad includes an axial bore that communicates with the gap to form a water passage with the gap and the peripheral channel.

42. The compliant guide assembly of claim 41, wherein the base plate has a central aperture that allows the second compression pad to seat directly against the support structure, wherein the first compression pad is attached to the base plate around the aperture, and wherein the support structure has an aperture located so that the support structure aperture is in communication with the axial bore when the guide is attached to the support structure.

* * * * *